US006832655B2

(12) United States Patent
Ravensbergen et al.

(10) Patent No.: US 6,832,655 B2
(45) Date of Patent: Dec. 21, 2004

(54) METHOD FOR CLEANING GRAVEL PACKS

(75) Inventors: John Ravensbergen, DeWinton (CA); John Gordon Misselbrook, Houston, TX (US); Lance Nigel Portman, Singapore (SG)

(73) Assignee: BJ Services Company, Houston, TX (US)

( * ) Notice: Subject to any disclaimer, the term of this patent is extended or adjusted under 35 U.S.C. 154(b) by 117 days.

(21) Appl. No.: 10/256,736

(22) Filed: Sep. 27, 2002

(65) Prior Publication Data

US 2004/0060698 A1 Apr. 1, 2004

(51) Int. Cl.[7] ..... E21B 37/08
(52) U.S. Cl. ..... 166/311; 166/312; 166/304
(58) Field of Search ..... 166/276, 304, 166/311, 312, 278, 222, 223

(56) References Cited

U.S. PATENT DOCUMENTS

| | | | | | |
|---|---|---|---|---|---|
| 1,379,815 | A | * | 5/1921 | Hall | 166/146 |
| 2,657,753 | A | * | 11/1953 | Carpenter | 166/302 |
| 4,037,661 | A | * | 7/1977 | Ford | 166/311 |
| 4,040,486 | A | * | 8/1977 | Kirkland, Jr. | 166/311 |
| 4,046,199 | A | * | 9/1977 | Tafoya | 166/303 |
| 4,482,016 | A | * | 11/1984 | Richardson | 166/300 |
| 4,694,901 | A | * | 9/1987 | Skinner | 166/222 |
| 4,765,410 | A | * | 8/1988 | Rogers et al. | 166/303 |
| 4,771,829 | A | * | 9/1988 | Sparlin | 166/233 |
| 4,919,204 | A | | 4/1990 | Baker et al. | 166/223 |
| 5,069,285 | A | * | 12/1991 | Nuckols | 166/311 |
| 5,533,571 | A | * | 7/1996 | Surjaatmadja et al. | 166/222 |
| 5,603,378 | A | * | 2/1997 | Alford | 166/222 |
| 5,783,526 | A | * | 7/1998 | Dobson et al. | 507/261 |
| 5,836,394 | A | * | 11/1998 | Blank | 166/312 |
| 6,336,502 | B1 | | 1/2002 | Surjaatmadja et al. | 166/104 |
| 2002/0139532 | A1 | * | 10/2002 | Todd et al. | 166/300 |

OTHER PUBLICATIONS

Fowler, S.H., "A Reeled–Tubing Downhole Jet Cleaning System," *Society of Petroleum Engineers*, SPE 21676:411–416 (Apr. 7–9, 1999).
Connell, Michael L. et al., "Coiled Tubing–Deployed Jetting Tool Enhances Cleaning and Jet Cutting," *Society of Petroleum Engineers*, SPE 60705 (Apr. 5–6, 2000).
Cobb, Charles C., "New Coiled Tubing Jet Cleaning System Reduces Costs," *Petroleum Engineer Int'l* (Oct. 1985).
Brochure entitled Hydra–Blast® Pro[SM] Service, by Halliburton Energy Services, Inc. (Dec. 1999).
Brochure entitled "Roto–Jet™ Precision Rotary Jetting Technology," by Nowsco.
Stanley, F.O., "Matrix Acidizing Horizontal Gravel–Packed Wells for Fines Damage Removal," *Society of Petroleum Engineers*, SPE 65519:1–10 (Nov. 6–8, 2000).
Stanley, F.O., "An Economic, Field–Proven Method for Removing Fines Damage from Gavel Packs," *Society of Petroleum Engineers*, SPE 58790 (Feb. 23–24, 2002).
Arangath et al., "A Cost–Effective Approach To Improve Performance of Horizontal Wells Drilled in High Permeability Formations," *Society of Petroleum Engineers*, SPE 73786 (Feb. 20–21, 2002).

* cited by examiner

*Primary Examiner*—David Bagnell
*Assistant Examiner*—Dan Stephenson
(74) *Attorney, Agent, or Firm*—Howrey Simon Arnold & White, LLP

(57) ABSTRACT

A method for cleaning a plugged gravel pack in a subterranean wellbore is provided. The method comprises the steps of using a pressure pulsating jet and a tangential vortex to deliver a pressure pulsating treatment fluid into the gravel pack wherein soluble plugging materials in the gravel pack are dissolved by the treatment fluid and insoluble plugging materials are moved through the gravel pack and circulated out of the wellbore. The treatment fluid is driven into the gravel pack to dissolve soluble fines and displace insoluble fines from the interstitial pore spaces of the gravel pack.

48 Claims, 6 Drawing Sheets

METHOD FOR CLEANING GRAVEL PACKS

FIELD OF THE INVENTION

The present invention relates to a method of cleaning plugged gravel packs, gravel pack screens and perforation tunnels in a wellbore. More particularly, it relates to a method for cleaning and/or removing plugging materials from a gravel pack completion without damaging the gravel pack material.

BACKGROUND OF THE INVENTION

Over time, most gravel packs will slowly lose permeability due to the reduction in pore space of the pack. This reduction in pore space can be caused in two ways. First, a scale can precipitate out of the well's produced fluids. In addition, fines can migrate out of the formation and be trapped in the gravel pack. The pore spaces of the gravel pack become plugged with these precipitates or formation fines. These factors lead to an overall reduction in permeability, resulting in lower production rates.

The plugging medium can potentially be removed from the gravel pack, by dissolving the plugging materials with chemicals or treatment fluids. However the insoluble plugging materials must be removed mechanically.

The present invention applies both chemical and mechanical techniques to clean a dirty, plugged gravel pack. It should be used whenever a gravel pack, screen and/or perforation tunnels exhibit signs of losing permeability due to plugging. The present invention can be used to remove soluble and insoluble fines, precipitates, scales and asphaltenes that can severely restrict the permeability of a gravel pack. Thus, the present invention satisfies a long felt need for a process capable of cleaning plugged gravel packs by removal of soluble and insoluble fines without damaging the gravel pack.

SUMMARY OF THE INVENTION

According to the preferred embodiment of the invention, treatment fluids are accurately placed through a gravel pack screen to treat a specific region of a gravel pack, its perforation tunnels, the pack/formation interface and the formation. Two preferred treatments include unplugging the pack by removing and/or dissolving fines and precipitates and placing water control chemicals.

The treatment fluid is uniformly placed behind a screen into a sand or gravel pack by generating a tangential vortex and a localized yet fluctuating pressure gradient in the pack. A tangential vortex is a circulating current spinning about an axis substantially tangential to the wellbore. The tangential vortex directs at least a portion of the return flow of the treatment fluid through the screen and up the gravel pack annulus before entering back through the screen. The efficiency of placing the treatment fluid is increased because the treatment fluid is returned to the surface by way of the gravel pack annulus. The fluctuating pressure gradient drives radial fluid flow through the pack. The fluctuating pressure gradient is achieved by the controlled rotation of a jetting nozzle operating at a flow rate sufficient to generate an impact pressure at the screen proppant interface, yet below a pre-determined critical damage threshold pressure. As use herein, impact pressure shall mean the stagnation pressure of the jet on the surface it impacts. The critical damage threshold pressure shall be understood to mean the pressure at which the impact pressure and the length of time the pressure is applied, is great enough to break more than a small percentage of the proppant particles in the gravel pack. For example, API Recommended Practice 58, permits a maximum of 2% fines for gravel pack proppants in a sieve analysis.

The fluctuating pressure gradient causes the proppant to oscillate and thereby creating relative motion between the particles. This relative motion, not only increases the rate at which treatment fluid can invade a pack but increases the rate at which particles can be mobilized into the flow stream to be transported out of the pack. The oscillating of the proppant particles reduces the friction between the fines and proppant. The forces created by the viscous drag of the fluid on the fine particle can more easily remove it from the pack.

In addition, the energy level of the oscillating pressure at higher impact pressures is enough to abrade deposits off the surface of the proppant particle. The higher strength of man-made proppants can accommodate these high energy levels. Therefore, there are two mechanisms at play to remove fines and precipitates from the pack, first to dissolve the soluble fine particle by chemical means, the other is to abrade the precipitate off the proppant, reduce friction between the particles thereby increasing the rate the particles will mobilize into the flow stream, along with other non-soluble fines and transport them out of the pack.

Rotational motion of the nozzle creates pressure pulsing, which has also proven to be an effective way to clean unwanted deposits (e.g., scales, waxes and asphaltenes) off the inside diameter of the screen face.

A method of uniformly placing a treatment fluid behind a screen in a gravel pack in a wellbore according to one embodiment comprises the steps of delivering a pressure pulsating jet of treatment fluid through a jet nozzle against the screen, and creating a tangential vortex beneath the jet nozzle with the treatment fluid wherein at least a portion of the treatment fluid is directed through the screen and into the gravel pack before returning to the surface. The jet nozzle may be oriented to have an axial downward component to the jet direction. An annular region of slurry with low proppant concentration is created behind the screen wherein the flow rate of the treatment fluid in the upwards direction in the annular region is maintained above the threshold transport velocity to suspend the proppants in the annular region.

A method of cleaning a gravel pack in a wellbore according to another embodiment comprises the steps of positioning a pressure pulsating jet inside a gravel pack screen, delivering a pressure pulsating treatment fluid into the gravel pack through the gravel pack screen with a pressure pulsating jet, dissolving soluble plugging materials in the gravel pack with the treatment fluid, and moving insoluble plugging materials through the gravel pack and circulating the insoluble plugging materials out of the wellbore. The method further comprises displacing the treatment fluid with a displacement fluid with the pressure pulsating jet. In another embodiment of the invention, a method of washing a plugged or partially plugged gravel pack and wellbore comprises the steps of delivering a pressure pulsating treatment fluid into the gravel pack, dissolving soluble fines located in the interstitial pore spaces of the gravel pack with the treatment fluid and reducing the pressure drop as a fluid flows into and through the plugged or partially plugged gravel pack by oscillating the fines contained in the gravel pack with the pulsating fluid. The method further comprises oscillating insoluble and yet undissolved fines located in the interstitial pore spaces of the gravel pack with the pressure pulsating treatment fluid until the insoluble fines move through the gravel pack, and circulating the insoluble fines out of the wellbore. Full coverage of the gravel pack is provided by controlling the flow rate, rate of penetration and impact pressure. Damage is prevented by controlling the impact pressure and flow rate to correspond to the specific gravel pack design. The reaction time between the treatment fluids and the fines and gravel particles may be controlled to prevent damage to the gravel particles. Thus, one is able to pump treatment fluids that will react with both the plugging fines and gravel particles, but because the surface area to volume ratio of the fines is much higher, the fines can be substantially dissolved without damaging the gravel particles.

According to another embodiment of the invention, a method of cleaning a gravel pack in a wellbore is provided comprising the steps of positioning a pressure pulsating jet inside the gravel pack, delivering a pressure pulsating treatment fluid into the gravel pack with the pressure pulsating jet and creating a radial pressure gradient within the gravel pack as the pressure pulsating jet is moved through the gravel pack.

One aspect of the invention is directed to a method of washing a gravel pack in a wellbore comprising the steps of delivering a pressure pulsating treatment fluid into the gravel pack with a pressure pulsating jet and a tangential vortex and dissolving soluble plugging materials in the gravel pack with the treatment fluid.

Another aspect of the invention is directed to a method of washing a gravel pack in a wellbore comprising the steps of delivering a pressure pulsating fluid into the gravel pack with a pressure pulsating jet and a tangential vortex, moving insoluble plugging materials through the gravel pack with the fluid and circulating the insoluble plugging materials out of the wellbore.

The pressure pulsing of the present invention is an improvement over prior jetting systems. The pressure pulsing vibrates plugging materials in the gravel pack. This oscillating movement and/or vibration leads to greater efficiency in delivering treatment fluids deeper and more completely through a gravel pack and into the perforation tunnels. The appropriate impact pressures utilized by the present invention provide sufficient energy to oscillate the fines yet not damage the gravel pack. Thus, production may be improved by dissolving soluble fines and removing insoluble fines from the pore spaces of the pack. Additional objects, features and advantages will be apparent in the written description that follows.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiments presented herein.

DESCRIPTION OF ILLUSTRATIVE EMBODIMENTS

Figure 1:
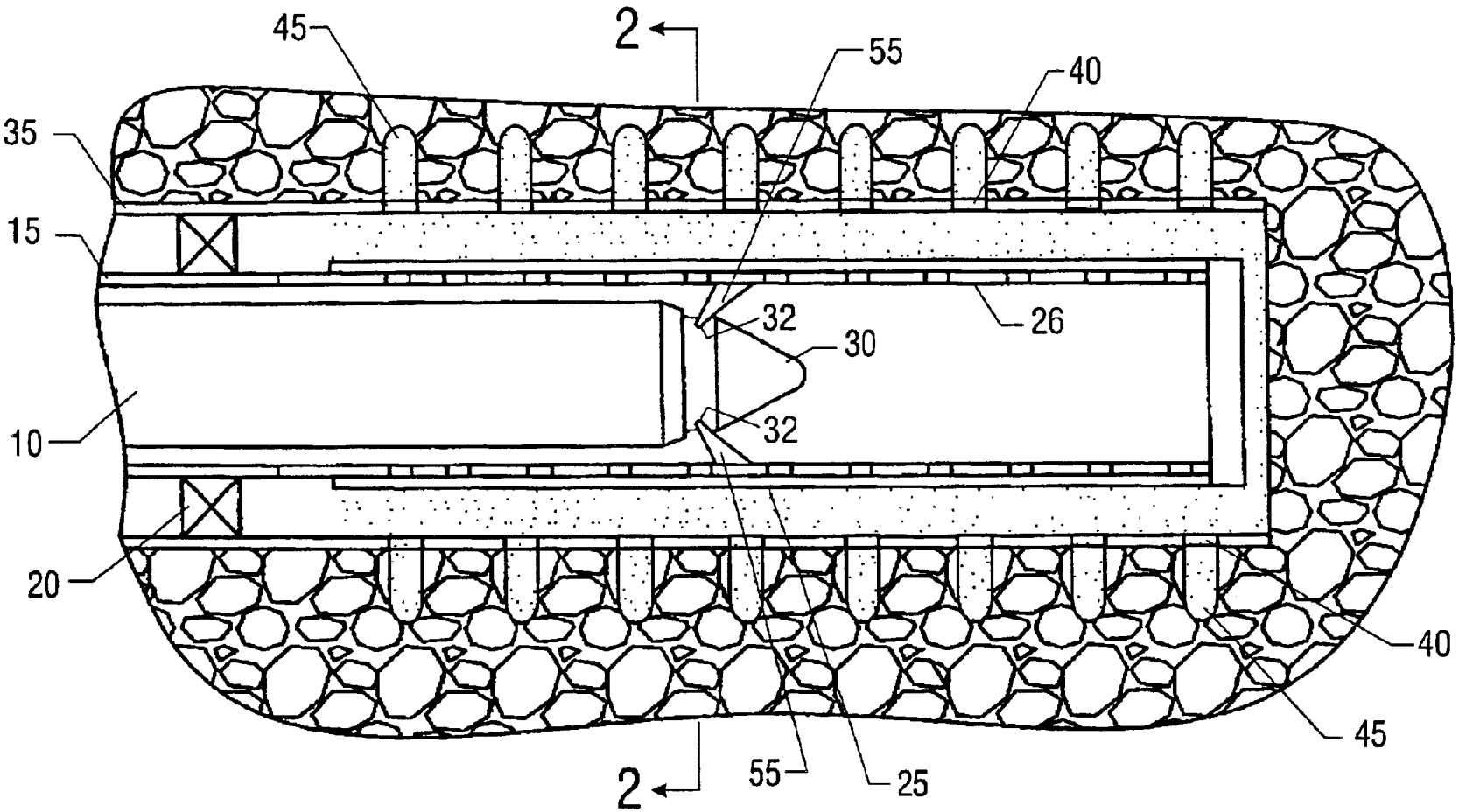
FIG. 1 illustrates a pressure pulsating jet washing a gravel pack in a wellbore.
Figure 2:
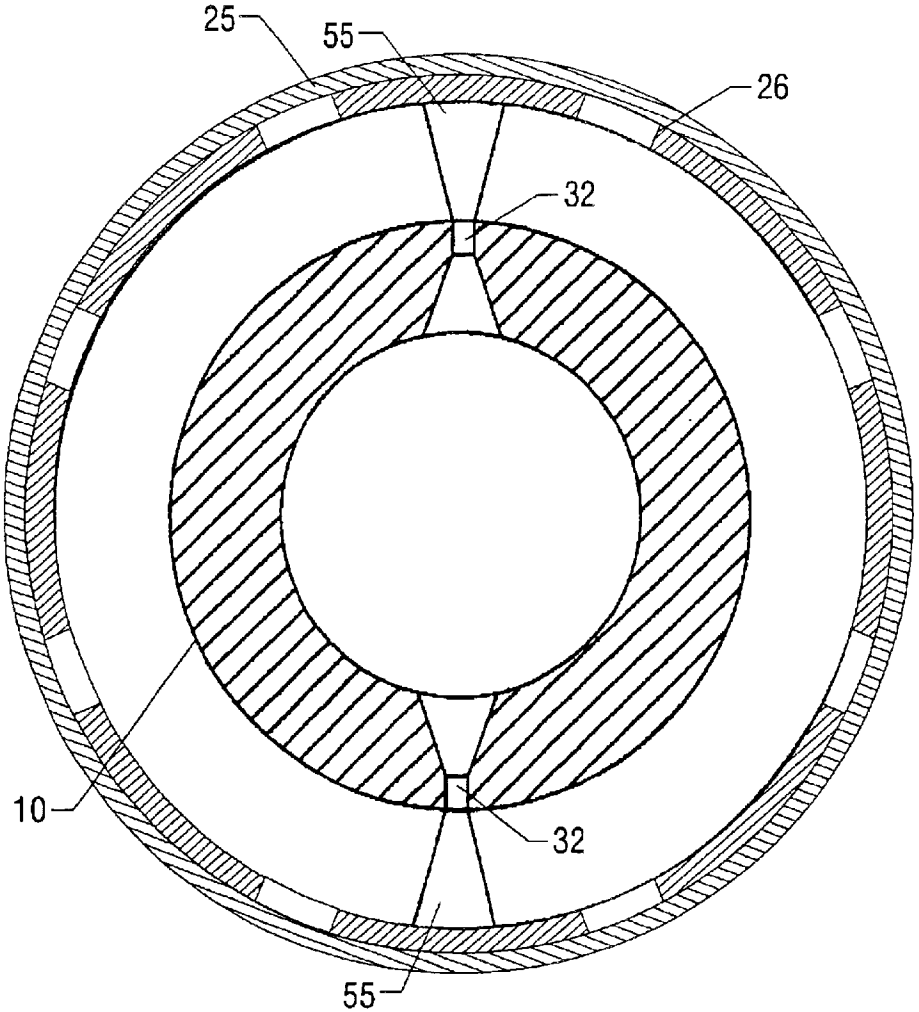
FIG. 2 is a section view of the pressure pulsating jet of FIG. 1.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

In one embodiment of the present invention, a solvent, acid treatment or enzyme treatment, is provided to remove the soluble materials from a dirty, plugged gravel pack. The key to the treatment is the chemicals are not simply bullheaded into the well. The chemicals are placed and removed from the gravel pack in a controlled and optimized manner preferably using coiled tubing and a pressure pulsating jetting apparatus such as the Roto-Jet™ tool offered by BJ Services Company.

The Roto-Jet™ is a pulsating pressure jetting apparatus which when used in accordance with the present invention forces the treatment fluids into the pore space of the gravel pack. The chemicals are driven into a very localized area of the pack and not just indiscriminately pumped into the well bore, thereby finding the path of least resistance. This is achieved by a high velocity pulsed jet directed precisely into the gravel pack. The kinetic energy of the pulsing fluid delivers the treatment fluids through perforated base pipe, through the wire wrapped screen and through the gravel pack and into the perforation tunnels. In the same manner in which the treatment fluid is placed it can be displaced (thereby removed) by another treatment fluid or a non-treatment fluid to flush out the original treatment fluid. Again the accuracy with which the fluid can be placed and the ability to force fluid into the perforation tunnels is the key. The flow rates, rate of penetration ("ROP"), pulse rate, and jet pressures are controlled in a manner to ensure complete coverage of the gravel pack by the treatment fluids. Not only is this process more effective as it ensures maximum interaction between the soluble fines and the treatment fluid, but is also more economical. A controlled volume of treatment fluid may be precisely placed as opposed to an indiscriminate volume flowing to the path of least resistance.

The second advantage of this pressure pulsating system is the removal of insoluble fines. In some instances, a large percentage of the materials plugging the gravel pack can be insoluble and in this situation a chemical reaction can not be the primary treatment process. A pulsating jet, such as created by the Roto-Jet™, hydraulically oscillates the plugging fines within a gravel pack, ultimately transporting the insoluble fines (as well as any yet to be dissolved soluble fines) out of the pack where they may be circulated to the surface and out of the well. The pulsating jet mobilizes the fines, dislodging them from in-between the sand particles of the gravel pack. A momentum exchange between the pulsating fluid and the solid matter in the gravel pack occurs. This momentum exchange causes both the pack sand particles and the plugging solids contained therein to oscillate.

This vibration mobilizes the plugging fines into the circulating currents set up by the tangential vortex. However, the hydraulic power (i.e., the flow rate multiplied by the impact pressure) of the pulsating jets must be controlled to ensure there is minimal damage to the pack. If the hydraulic power is too high it is possible to break up and remove pack sand, thereby creating voids. Voids that are not subsequently filled by the excess sand (or proppant) originally deposited above the perforations can lead to produced well fluids jetting and eroding a hole in the wire wrapped screen, resulting in a failed gravel pack. If the hydraulic power is too low the process suffers loss in efficiency.

Excessive fluid "jet-velocity" can cause excessive particle oscillation leading to sand grain fragmentation and abrasion leading to the generation of "fines." "Fines" will be flushed out of the pack and through the screen. However, grain fragmentation is not an isolated event and repeated "cycles" will continue to generate "fines" and over time the pack volume will diminish. Rate of generation of "fines" (i.e., pack contraction) can be minimized to negligible levels by controlling the "impact pressure" and the number of times the nozzles passes by a wellbore location. The compromise is to reduce impact pressure and number of passes such that negligible levels of fines are generated. Preferably, the level of fines left behind will be no more than the minimum level as allowed by API Recommended Practice 58, "Recommended Practices for Testing Sand Used in Gravel Packing Operation."

It is the above described combination of chemical and mechanical methods that can effectively remove both types of blockages from a gravel pack, and with proper implementation, there is little risk of damaging the gravel pack. It will be appreciated that the described methods are also effective in removing such blockages from a frac pack. The present invention will deliver treatment fluids to the fractures extending from the perforation tunnels. For the purposes of brevity, the term "gravel pack" as used herein will include both gravel packs and frac packs, as those terms are used in the art.

According to a preferred embodiment, controlled "pulsing" through rotation causes oscillation of the proppant and plugging materials. Pulsing and a tangential vortex allows fluid to invade the plugged pack more quickly than other processes. Treatment fluid can thus be introduced into the pack and reach the site of the plugging material and dissolve it more efficiently.

Figure 3:
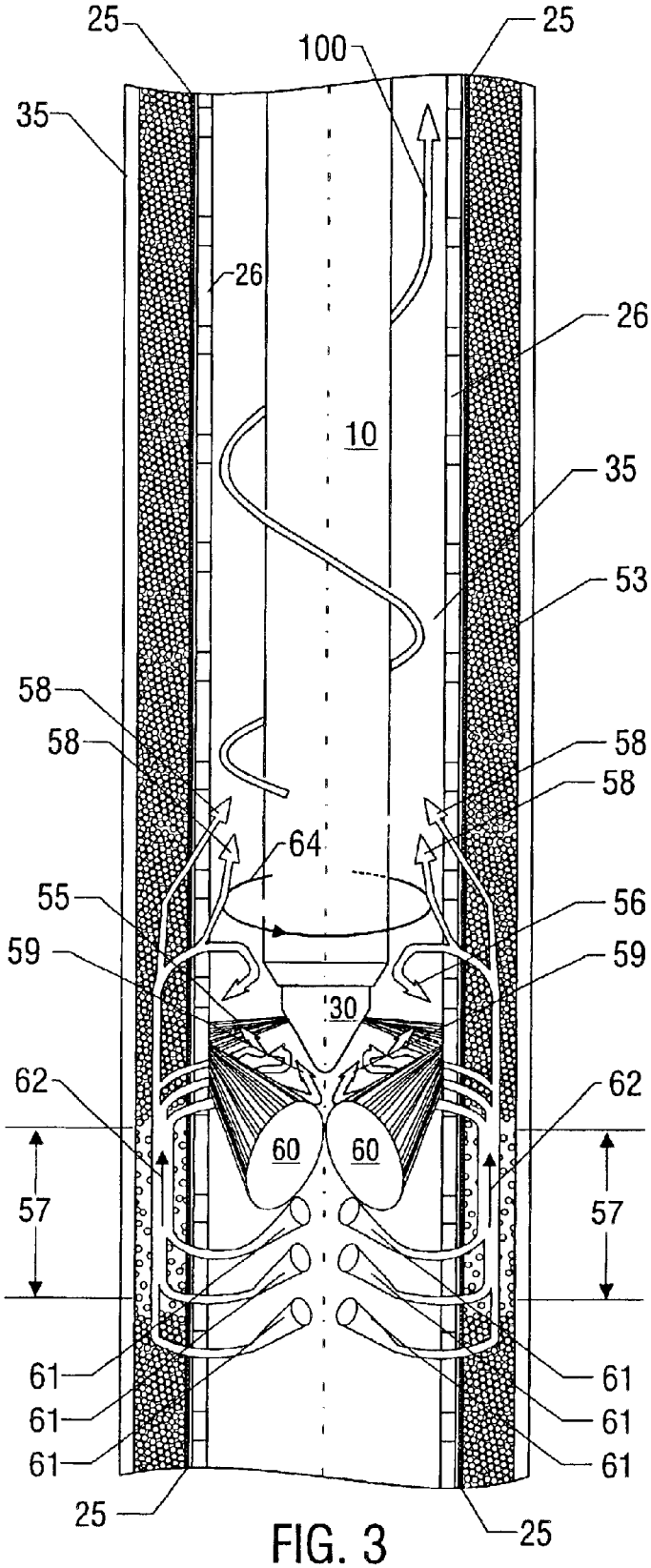
FIG. 3 illustrates the tangential vortex created by a pressure pulsating jet to wash a gravel pack.

Fluid invasion into the pack is highly localized in the axial direction and extends radially in the vicinity of the tool nozzles and in the region immediately below the nozzles by the tangential vortex (FIG. 3). Therefore the process can be controlled such that the entire pack, perforation tunnels, and/or pack-formation interface receives treatment fluids.

Fluid can be accurately placed and subsequently removed/flushed away. Therefore, not only can the process deliver full coverage but the treatment time can be controlled as well. With formations, proppants or tubulars that are sensitive to treatment fluids, the Roto-Jet™ can wash the treatment fluid out of the gravel pack or near wellbore, yielding less potential for corrosion or secondary precipitate damage. Therefore, reduce treatment costs can be achieved by reducing treatment volumes and reducing/optimizing treatment time (thereby reducing rig time).

To better understand the present invention, one needs to consider how a gravel pack gets plugged with insoluble non precipitated fines. If a pack consisted of perfectly spherical particles of exactly the same size, it would be very difficult for particulate material to stop midway through the pack and get stuck in the pore spaces and therefore plug the gravel pack. The reality however is the gravel pack sand particles are not perfectly spherical and range in size. This leads to tapering flow channels and therefore a greater propensity to plug. For example, a common gravel pack sand is a 20/40 mesh with pore space sizes that will permit spherical shaped particles ranging in size from 0.0025" diameter to 0.0051" in diameter to pass through. Any particles larger than this will not enter the pack and particles smaller than this have a greater probability of passing through the gravel pack unimpeded. Therefore, particles of this size plugging the pack can pass through the pack if there is only small differential movement between the gravel pack sand particles when the pack is agitated by a pressure pulsating jet. In addition, irregular shaped particles can also be mobilized out of the gravel pack by oscillating the particles. Oscillation will reduce friction between the fines and the proppant particles, the fines can then rotate about their own axis into an orientation, that will allow the fluid flow to transport the fine particles through the pore spaces in the gravel pack.

FIG. 1 illustrates one embodiment of the present invention. A pressure pulsating jet apparatus, such as the BJ Services' Roto-Jet™, is shown cleaning a gravel pack. The pressure pulsating jet apparatus 10 is preferably run into the gravel pack attached to a coiled tubing (not shown). However, it will be appreciated by those skilled in the art that the pressure pulsating jet apparatus could be run on a conventional workstring. Preferably, the pressure pulsating jet apparatus, such as the Roto-Jet™, is run inside of the existing production tubing 15 past liner hanger 20 and into gravel pack screen 25, which is suspended from the production casing. A standard Roto-Jet™ has an outer diameter of 1¾ inches. Thus, the preferred rotary jetting tool will easily pass through typical production tubing, packers and screens. Screen 25 may be a conventional wire-wrapped base pipe screen or a commercially available premium screen such as Baker Oil Tools' Excluder™ screen or Weatherford Completion Services' Stratapac™ screen. Such screens are well known in the art. Alternatively, a slotted liner may be used with a gravel pack, or a pre-packed screen may be used, as is well known in the art. For purposes of this invention, it will be understood that such devices will collectively be referred to as a gravel pack screen. Sand particles 70 are packed in the annulus between screen 25 and casing 35. Common gravel pack sands which may be cleaned by the present invention include 12/20 mesh, 20/40 mesh and 40/60 mesh size particles. Such naturally occurring sands are available from Accumen or Badger mines. Gravel packs using similar sized man-made gravel, such as the commercially available CarboLite™ particles, manufactured by Carbo Ceramics, or Econo-prop, also manufactured by Carbo Ceramics, may also be cleaned by the present invention.

A plurality of perforations 40 provide communications between the surrounding hydrocarbon bearing formation and casing 35. Perforation tunnels 45 extend from the casing and through the surrounding cement sheath (not shown) and into the adjacent formation 50. The perforation tunnels are also packed with sand particles 70. As the pressure pulsating jet is lowered through the gravel pack, the jet 55 delivers a pressure pulsating fluid through the gravel pack screen, into the sand particles 70 of the gravel pack, and into the individual perforation tunnels.

Preferably, the bottom hole assembly providing the pressure pulsating jet is acid compatible. The preferred pressure pulsating jetting apparatus, the Roto-Jet™, uses a multistage fluid turbine (not shown) as an internal drive mechanism to drive mole 30 which spins a plurality of jet nozzles 32 mounted on the mole. The Roto-Jet™ includes a speed governor to control the speed at which mole 30 rotates. The fluid turbine is actuated by pumping fluid through the various stages. Typically, the fluid would pass through a downhole filter section at the top of the tool and then enter the turbine. The entire volume flow rate may be directed through the turbine blades or a portion of the flow may be directed through the center of the turbine shaft to adjust the rotational speed of the mole, as discussed below. The combined flow then passes into the jetting mole fixed to the bottom of the turbine shaft, and leaves the tool via the plurality of jet nozzles mounted in the mole. Radial and thrust bearings are located near each end of the turbine shaft to handle the thrust forces acting on the tool. A rotary speed governor located immediately below the downhole filter is coupled to the turbine shaft. The governor controls the speed of the turbine by applying a drag torque which varies in proportion to speed. The drag torque is applied by a series of magnets radially spaced about the shaft of the governor. Rotational speed of the mole, and thus the jet nozzles, may be adjusted by altering the number of turbine stages, altering the number of magnets in the governor or changing the size of an orifice which controls the amount of fluid that may be diverted through the center of the turbine shaft. The rotational speed of the mole can be slowed by removing turbine stages, adding additional magnets to the governor or by diverting more fluid through the turbine shaft using a larger shaft bypass orifice. Conversely, rotating of the mole can be increased by increasing the number of turbine stages, removing magnets from the governor or by diverting less fluid through the turbine shaft using a smaller shaft bypass orifice. Thus, for any given gravel pack washing, the desired rotational speed of the pulsating jet nozzles may be determined in advance and corresponding alterations to the jetting tool may be made at the surface before running the tool into the wellbore.

In a preferred embodiment, the Roto-Jet™ has a pair of jet nozzles spaced 180° apart and oriented at a 75° angle from the axis of the tool for man made proppants. When activated, the jet nozzles spin around at speeds preferably ranging from about 100 rpm to about 800 rpm. Rotational speed of about 400 rpm is the optimum speed for scale removal. The repeated and rapid passage of the jet-stream from each nozzle creates a pressure pulsating radial pressure gradient throughout the treated area. Once the jet stream from a nozzle passes a given point, the fluid pressure dissipates until the next jet nozzle passes the same point. In this way, the Roto-Jet™ delivers a pulsating, on/off, pressure radially inside the gravel pack.

The optimum tool set-up for gravel pack cleaning can be achieved with a tangential vortex. As shown in FIG. 3, the tangential vortex is a circulating current spinning about an axis substantially tangential to the wellbore. With two opposing jets, there is an axial component for the axis of the vortex.

To establish a tangential vortex the jets 55 have an axial downward component to the jet stream direction, the downward component of the jet stream direction either directly or after the jet as struck the inner diameter of the base pipe. The jets thereby cause fluid to flow down the wellbore for a distance before the flow decelerates, stops and returns back up the wellbore (represented by arrow tails 61). Depending on the strength, or energy level of the jets, some of the fluids near the jet are entrained in the jet stream, as shown by arrows 59. Therefore, the jets and the fluid entrained causes a tangential vortex, represented by the arrows 55, 60, 61, 62 and 59.

Further, if the energy levels of the jets are large enough, such that the cross sectional area of the jet(s) stream is large enough as it diverges, then a significant portion of cross sectional area of the base pipe will contain jet(s) with fluid flow in the downward direction. Therefore the cross sectional area 60 of the jets, at a given throw distance, is large enough to restrict the returning fluids from flowing up the wellbore inside the base pipe. The path of least resistance becomes the path through the screen and into the gravel pack annulus 53, as illustrated by arrows 62. If the flow rate in the annulus is great enough and in the upward direction (i.e., greater than the threshold transport velocity of 4 inches/second) the flow will suspend and transport the proppant particles. Since the flow is in the upward direction the proppant particles are suspended against the pull of gravity.

As the bottom hole assembly (BHA) is lowered or lifted in the wellbore, an annular region 57 of slurry with low proppant concentration develops. The packing density of the proppant particles is less than the maximum possible body centered cubic stacking, and therefore void spaces exist in the gravel pack. Therefore as the BHA is lowered or lifted in the wellbore, the void spaces can be captured by the fluid with a velocity above threshold transport velocity. As the BHA travels up or down the wellbore the accumulation of void space can grow up to a maximum volume, the region of annulus with flow rates above the threshold transport velocity. This region has low proppant concentration slurry.

Under these conditions, the efficiency of placing treatment fluids into the pack is dramatically increased. In the absence of a tangential vortex the pumped treatment fluids can return to surface without entering the gravel pack annulus. The efficiency is therefore increased because the fluid flowing from the jets flows into the annulus, instead of flowing back up inside of the base pipe, thereby returning to surface by way of the annulus 53 of the gravel pack. In addition, the flow rate in the annulus is great enough to suspend proppant particles. This leads to an annular ring of slurry with low proppant concentration, further reducing the restriction to the flow. In this way, the annulus is flooded with pumped fluids or treatment fluids. Further, some of the treatment fluid is circulated more than once through the annulus, as it is re-entrained into the jet stream. The proppant particles are thereby thoroughly washed with reactive chemicals. Since, most of the expensive treatment fluids pass through the annulus, the cost of the treatment can be reduced. Further the time to place treatment fluids into the pack can be reduced, further improving the economics.

Another benefit of this process is a balance can be achieved for the hydraulic power of the jet stream between the impact pressure and the tangential vortex. Decreasing the jet angle, as illustrated in FIG. 3, decreases the impact pressure for a given flow rate and jet pressure, but increases the flow rate and velocity of the fluid in the downward direction inside the base pipe thereby increasing the strength of the tangential vortex. Decreasing the jet angle, decreases the rate of damage to the proppant particles. Therefore an optimum jet angle can be determined, such that damage to the proppant particles is minimized but enough hydraulic power is supplied to create a tangential vortex and pressure oscillations.

Therefore a tangential vortex can deliver a large fraction of the pumped fluids into the gravel pack annulus. A tangential vortex can also circulate fine particles, whether produced fines, or small particles of precipitate broken up by the pulsating jets out of the gravel pack. Gravel particles will not circulate out of the pack as the screen traps them in the annulus. The low concentration proppant slurry region transports fines out of the pack, since this region is predominantly fluid, proppant particles do not impede the fines from travelling out of the annulus. Proppant damage is also minimized with a tangential vortex as low hydraulic power is required to flow treatment fluid into the pack and to transport fines out of the pack.

The rotating action of the Roto-Jet nozzles provide full wellbore coverage. A variety of jet nozzle configurations and number may be used. For example, the jet nozzles may be configured to have two opposing jets with a radial 90° discharge angle with the longitudinal axis of the tool. This angle is optimum to achieve a maximum impact pressure for a given nozzle pressure and flow rate, thereby generating the largest pressure pulsation in the gravel pack. However for a tangential vortex, the 90° discharge angle is the least preferred. When the jet impacts the inside of the base pipe, only half the flow has the potential to travel in the downward direction. Only flow in the downward direction sets up a tangential vortex. Therefore in the preferred embodiment the discharge angle for man made proppants is about 75°. This enables strong impact pressures and enough downward fluid rate and momentum to create the tangential vortex. Since man made proppants are stronger and more consistent in strength than naturally occurring proppants, higher impact pressures can be used with man-made proppants than naturally occurring proppants. Reducing the discharge angle for a given hydraulic power reduces the impact pressure, yet increases the fluid flow rate and velocity in the downward direction. Therefore reducing the discharge angle can be used to lower the impact pressure and increase the strength of the tangential vortex. For example, a 75° nozzle with a jet stream of 100 liters/min. and nozzle pressure of 1200 psi does not have the hydraulic power to create the tangential vortex and has an impact pressure of 200 psi. An impact pressure of 200 psi damages the naturally occurring sand in a gravel pack. If the same flow and pressure is directed through a nozzle at 45°, the impact pressure reduces to 70 psi and there is enough downward flow rate and velocity to power the tangential vortex and dramatically reduce the rate of damage. A tangential vortex may be created using a single jet nozzle or an array of several jet nozzles.

A variety of jet orifice is available to optimize the impact pressure and hydraulic horsepower to be applied to the pack. Common sizes include 0.110 inches, 0.119 inches, 0.126 inches, 0.141 inches and 0.161 inches in diameter.

A substantially plugged gravel pack can not receive sufficient treatment fluid into the pore space of the gravel pack to dissolve soluble fines located in the pore spaces. Because the pore spaces are not 100% plugged, there is still some pore space to let fluid in but without mobilizing the fines and moving them within the pore space the ability to deliver the treatment fluid into the entire pack is severely handicapped. Inducing a pulsating action in the fluid flow allows the treatment fluid to drive completely into the pack to obtain substantially full coverage of the gravel pack thereby increasing the ability to remove both the soluble and insoluble fines. The pressure pulsing allows the acid or solvent fluids to flow deeper into the gravel pack and into the perforation tunnels due to the decrease in flow resistance through the gravel pack. Pressure pulsing reduces friction between proppant particles to aid in the creation of the tangential vortex. The reduced friction between the proppant particles created by the pressure pulsing also reduces the angle of repose, thereby increasing the proppant packing density in the annulus and in the perforation tunnel.

Pressure pulsing can break the bonds between the proppant particles and any cementations precipitate in the gravel pack. Pressure pulsing also removes unwanted deposits such as scale, waxes and asphaltenes from the inner diameter of the screen. Thus, it is possible to remove unwanted deposits (e.g., scale) from the screen and then remove plugging materials from the gravel pack in a single trip. The rotating jet (rotating in the direction indicated by arrow 64 in FIG. 3) increases the quantity of wellbore fluids entrained into the jet and provides full coverage of the gravel pack.

Figure 4:
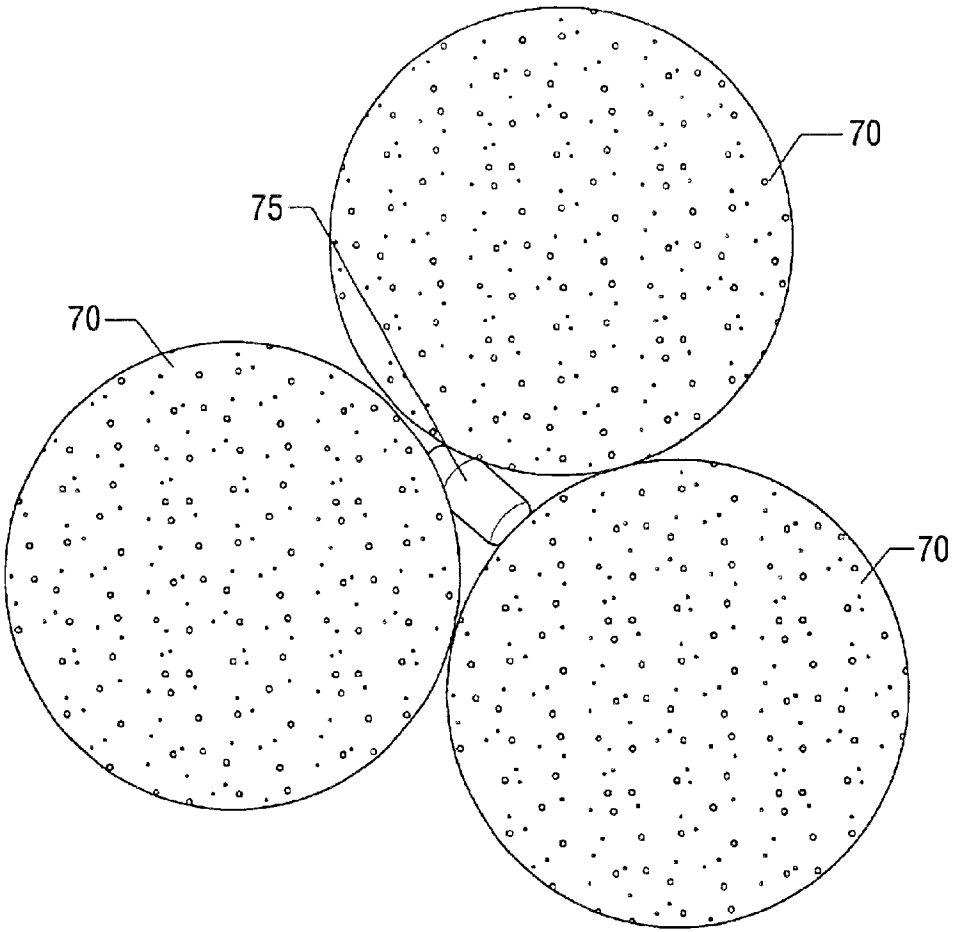
FIG. 4 illustrates a fine plugging the interstitial pore space between sand particles in a gravel pack.
Figure 5:
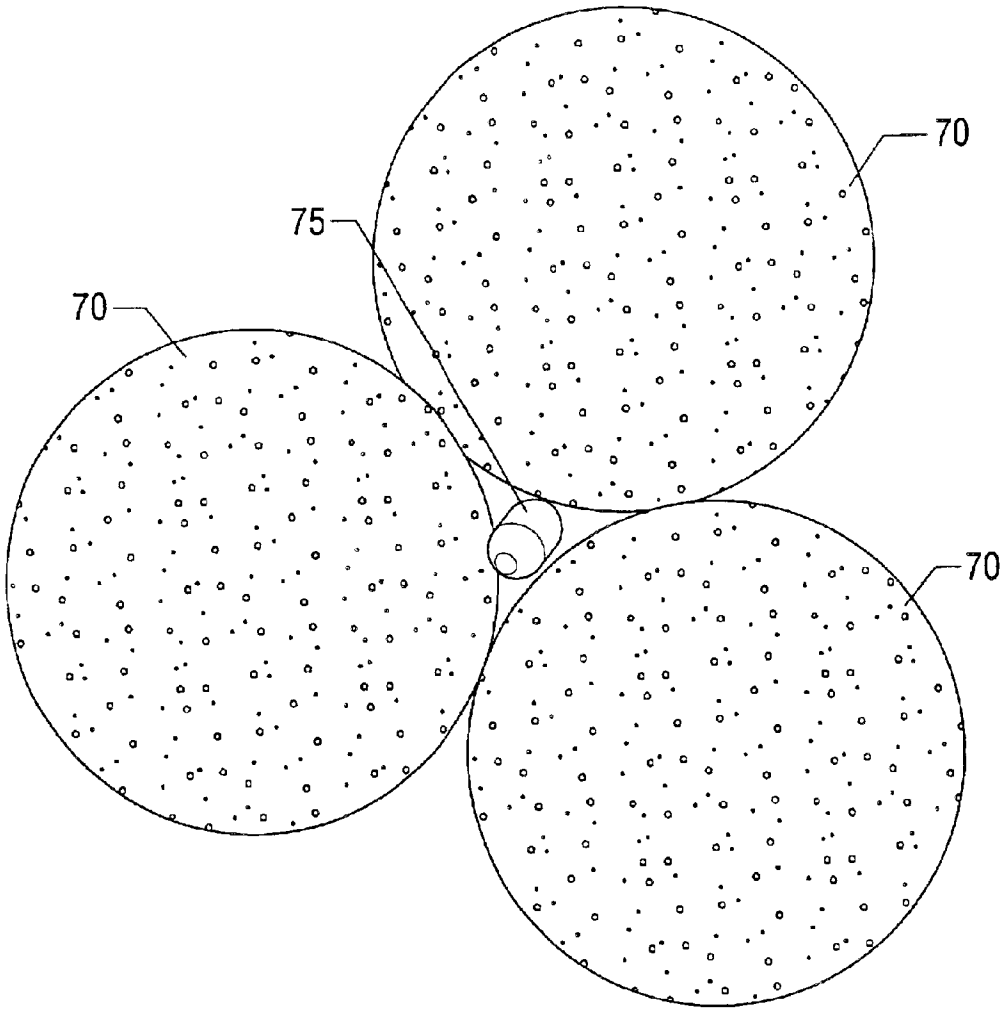
FIG. 5 illustrates the fine of FIG. 3 after it has been oriented for passage through the interstitial pore space of the gravel pack by the pulsating treatment fluid of the present invention.

The pressure pulsing also causes relative movement between the plugging fines and the sand particles and this in turn permits insoluble or non-dissolved solids to move through and ultimately out of the pack. This mechanical removal of plugging materials from the pack is illustrated in FIGS. 4 and 5. FIG. 4 shows a plugging fine 75 trapped in the pore space between sand particles 70. Fine 75 is blocked from moving through the gravel pack because of its orientation. FIG. 5 illustrates fine 75 after its orientation has been changed due to movement caused by the pressure pulsing treatment fluid. As shown in FIG. 5, fine 75 is now oriented so that it can pass through the pore space between particles 70.

Once the pressure pulsing fluid has been delivered through the gravel pack screen and into the gravel pack and perforation tunnels, the fluid then recirculates back through the screen 25 and perforated base pipe 26. A portion of the returning fluid 59 will be entrained in the jet stream and be recirculated by the jet stream back through the gravel pack annulus. The remaining fluid 58 will begin flowing up the annulus between the tool and inner diameter of the perforated base pipe 26. Ultimately, the insoluble and non-dissolved particles are circulated out of the well with the main fluid flow, shown by arrow 100 in FIG. 3. Thus, the pulsating fluid is driven into the pore spaces and dissolves the soluble fines while also mobilizing the insoluble fines to allow the latter to be flushed out of the gravel pack where it can be circulated out of the wellbore by the displacing fluid.

A pressure pulsating jet can deliver a pulsating jet at a controlled pressure into the gravel pack without damaging the gravel pack. The pulsating jet mobilize and displace the fines in the interstitial pore spaces in the gravel pack. Once the fines are mobilized, the treatment fluid can penetrate the gravel pack more efficiently.

In one embodiment of the invention, the treatment fluid is an acid such as hydrochloric acid, hydrofluoric acid or organic acids, such as acetic acid and formic acid, or combinations of these acids. Other acids suitable for use with the invention include acids such as Sandstone™ acid, available from BJ Services Company, and self generating acid systems. In another embodiment, the treatment fluid is a solvent. Suitable solvents include xylene, diesel alcohols, aromatic and non-aromatic hydrocarbons, and surfactant systems, as well as commercially available products such as Paravan™, available from BJ Services Company. In another embodiment, the treatment fluid includes non-acid reactive systems such as enzymes, bleach and oxidizing systems, chelating agents and combinations of these materials. One of skill in the art will also understand that some pumping schedules could involve stages of solvents followed by acid or solvents followed by non-acid reactive systems. Stages could be either single or multiple depending on the nature of the plugging problem.

The treatment fluid may also be a water control chemical. Placing these chemicals with the present invention may yield more effective treatments and allow optimization of treatment volumes.

The treatment fluid, such as acid, may be displaced with another fluid, such as water, sea water or KCl water. The displacement fluid is circulated by the pulsating jet and the tangential vortex into the gravel pack screen, the gravel pack itself, and the perforation tunnels and circulates the liberated insoluble fines out of the wellbore. The time a treatment fluid is permitted to soak, or remain in the gravel pack can now be controlled. Highly treatment fluids can now be considered since the reaction time can be controlled. Although the present invention is particularly well-suited to wash and clean a gravel pack in a cased hole, the invention can also be used to wash and clean open hole gravel packs.

Perforation tunnels are packed with proppant as fluid transports the proppant particles during the placement of the pack. However, perforation tunnels that are plugged by a drilling skin or by other mechanisms will receive little proppant as the fluid can not flow into the perforation tunnel and therefore can not transport the proppant. The pulsing action first helps to place treatment fluids into the perforation tunnel to remove the damage and then efficiently packs the tunnel with proppant by the mechanism described above. Bridging can also occur during a gravel pack. The pulsating treatment fluid described above can remove such bridges.

It is important not to break down or erode the proppant of the gravel pack, which would lead to a lower permeability of the pack. Thus, the preferred embodiment of the invention contemplates the delivery of the treatment fluid using appropriate impact pressure to avoid breaking or destroying a gravel pack particle. The maximum impact pressure the gravel pack can sustain is a function of proppant type, pack tightness, screen type, and proppant size. Through experimental testing the maximum impact pressure can be determined as a function of these variables. Once a maximum impact pressure is determined, flow rate, and rate of penetration can be optimized to ensure full coverage and optimum volume of treatment fluid per meter of interval.

Figure 6:
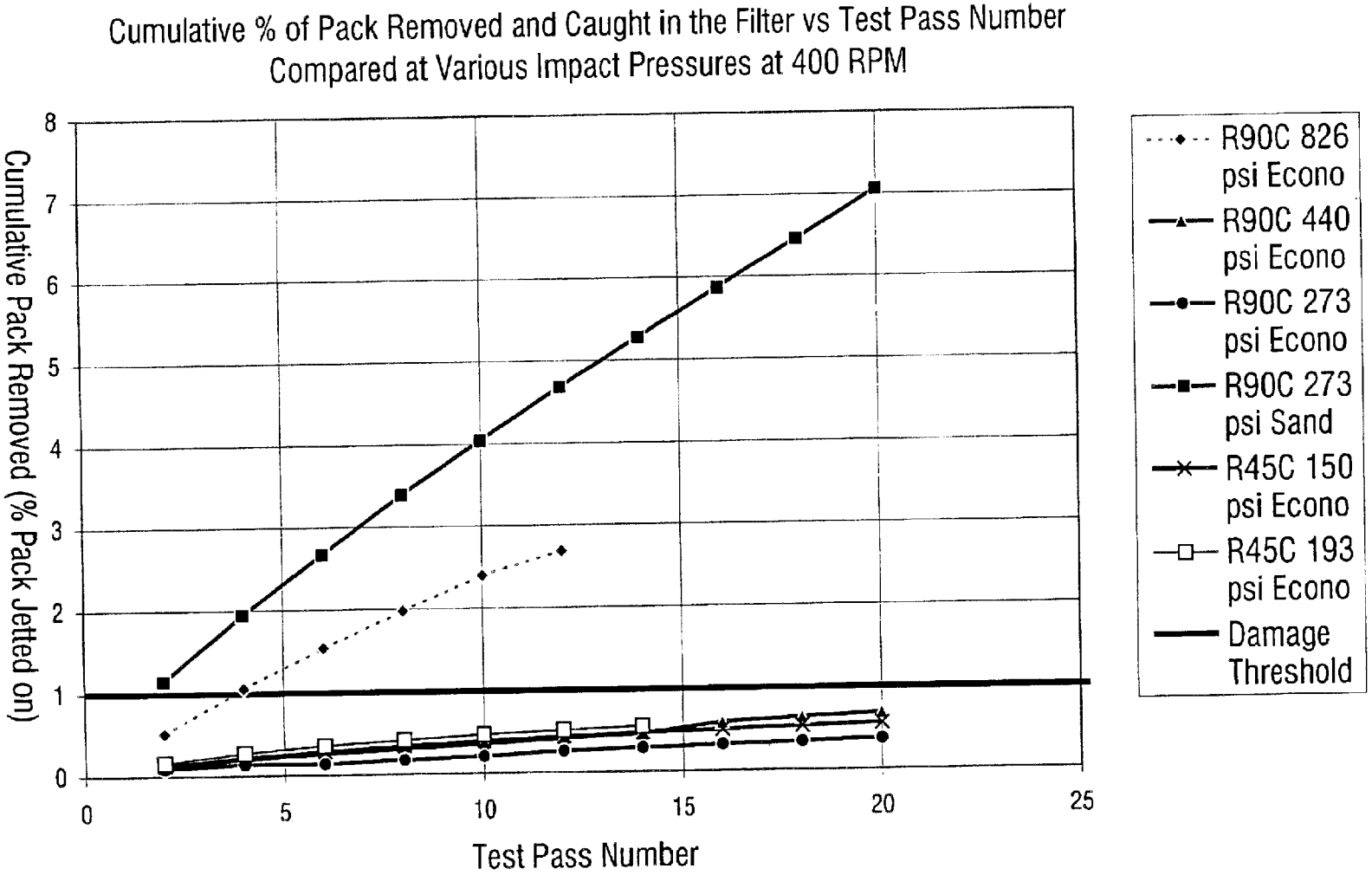
FIG. 6 is a graph of cumulative pack removed versus the number of passes for a pressure pulsating jet at various impact pressures on man made proppants and sand gravel packs.

By way of example, FIG. 6 is a graph of the cumulative pack removed (as a percentage of the pack jetted on) versus the number of passes through the test pack by the pulsating jet. The cumulative pack removed represents the damage caused by the breaking down or erosion of the proppant of the gravel pack due to the impact pressure. The damaged proppant is removed from the pack as a fine. FIG. 6 compares various impact pressures at 400 rpm on a vertical, pumped in, clean gravel pack with either 30/50 mesh Enono-Prop or 40/60 mesh Ottawa sand, a naturally occurring proppant. A 1% damage threshold was selected. This represented one half of the minimum level of fines allowed by the API Recommended Practice 58.

As can be seen in FIG. 6, for example, the cumulative damage caused by five passes at an impact pressure of 273 psi in a sand gravel pack is approximately ten times the damage caused to an Econo-Prop for the same parameters. Thus, excessive damage to the pack would be created by an impact pressure of 273 psi for the naturally occurring sand particles. Conversely, such an impact pressure would not cause excessive damage to a comparable wellbore packed with Econo-Prop.

Preferably, the critical damage threshold to the pack would be about 1% or less. However, the tradeoff for accepting a higher damage threshold is a more thorough cleaning of the gravel pack. Again, using FIG. 6 as an example, making 8 passes of the tool at an impact pressure of 826 psi through an Econo-Prop pack would remove about 2.0% of the pack compared to about 1.0% of the pack for 4 passes of the tool. Depending on the particular well, the more thorough cleaning of the pack by the additional passes of the tool may be worth the additional damage to the pack. Thus, a damage threshold of up to about 3%, for example, may be justified by the resulting cleaner pack. However, if too much proppant is removed from the gravel pack, the upper perforations may not be packed with gravel which could lead to the destruction of the gravel pack screen and the loss of the gravel pack filter.

During experimental testing it was determined that the maximum impact pressure that could be sustained by a pack was a function of the pack packing density. Therefore testing was done on packs that had a packing density or "tightness" representative of what is found in the typical oil & gas wells. However, after a treatment was placed with the Roto-Jet™, pack tightness increased. Pack density increases typically 5–10% by this process. This is due to the pressure oscillating of the fluid, reducing the angle of repose of the proppant particles, and decreasing the friction between the proppant particles. Therefore, higher packing density can be realized.

Depending upon the particulars of a given gravel pack, the pressure pulsating treatment fluid may be delivered at impact pressures, for example, ranging from about 5 psi to about 850 psi without damaging the pack. However, even with low to moderated impact pressures, the present invention provides for a more efficient placement of treatment fluids into a gravel pack. As a result, less time in the wellbore is needed to place the treatment fluid. The treatment fluid can be driven into the gravel pack quicker. Consequently, less treatment fluid is required to be pumped than with previous known methods of gravel pack washing. Since less time and less acid are required, the overall cost of washing a plugged gravel pack can be reduced with the present invention. By way of example, acid treatments on the order of about 40 liters/meter of gravel pack to about 400 liters/meter of gravel may be used with the invention. However, one of skill will appreciate that the volume of acid required to wash a gravel pack will depend on the size of the gravel pack.

In a preferred embodiment, an operating envelope has been established for the most effective system for cleaning gravel packs without causing pack damage. According to preferred method, the pressure pulsating jet is lowered through the gravel pack at a speed of about 0.2 meters per minute to about 10 meters per minute. Again, one of skill will understand that the speed of running the tool through a given gravel pack will depend on the particulars associated with the pack, such as the size of the gravel pack, the type and size of the gravel, and the dimensions of the downhole tubulars. Preferably, the treatment fluid is delivered to the gravel pack at a flow rate of about 40 liters per minute to about 400 liters per minute.

The following examples further illustrate the treatment of typical gravel pack configurations in accordance with embodiments of the present invention. It should be appreciated by those of skill in the art that the treatments and/or configurations disclosed in the examples which follow represent treatments and/or configurations discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

The following examples, as well as FIG. 6, are representative of tests conducted with a gravel pack cleaning test apparatus which was built to simulate downhole conditions. The test fixture was designed and built to include an axial feed system to simulate the rate of penetration (both lowering and raising) a bottom hole assembly which included the pressure pulsating jet. The fixture was adjustable to accept different sizes of completions and allowed the bottom hole assembly to be set concentrically or eccentrically with the simulated wellbore. A high pressure pump was attached to the fixture to allow fluid injection and pressures up to 6500 psi. In one embodiment, the fixture was fitted with a 6 inch outside diameter acrylic tube with a quarter inch thick wall to simulate the casing. Simulated perforations ¾ inch in inside diameter and 9 inches long were placed on the casings at 6 inch intervals. A 3½ inch base pipe wire wound screen was mounted inside the casing as per standard gravel pack. An alternative embodiment of the test fixture included a 7 inch outside diameter acrylic casing having a quarter inch wall was used with a 4 inch diameter base pipe screen. The 7 inch casing included the same perforation tubes as the 6 inch diameter casing. The annular volume between the screen and the casing was filled with gravel pack proppant and compressed by an annular piston to tighten the pack. The simulated gravel pack was approximately 56 inches in overall length. The test fixture could be oriented at various angles from vertical to horizontal.

EXAMPLE 1

A 2.125 inch outer diameter tool equipment with R90C nozzles (i.e., 90 degree, 0.126" diameter nozzle) is used to treat a typical Gulf of Mexico gravel pack (3.5 inch outer diameter perforated tubing as base pipe, with a 3.9 inch outer diameter wire wrapped (0.008 inch gap) screen, inside 7 inch casing (6.276 inch inner diameter) and 40/60 sand). The standoff to the outer diameter of the base pipe (or inner diameter of the wire wound screen) is 0.97 inch for the Roto-Jet™ when the bottom hole assembly is centralized. Typical flow rate for this configuration of Roto-Jet is 110 liters/minute results with a pressure drop across the nozzle of 1021 psi. The impact pressure at the inner diameter of the wire wrapped screen is 361 psi.

EXAMPLE 2

A fully eccentric 1.75 inch tool with R90C nozzles is used to treat the typical pack described in Example 1. All other parameters are the same as Example 1 (3.5 inch outer diameter base pipe, 3.9 inch screen outer diameter 6.276 inch inner diameter casing and 0.008 inch gap screen with 40/60 sand at 110 liters/minute). The stand-offs are 0.450 inch and 1.700 inches respectively. The pressure drop across the nozzle is 1138 psi and the maximum impact pressure (on the close side) is 760 psi and the minimum impact pressure (on the far side) is 136 psi.

EXAMPLE 3

Using a centralized 2.125 inch Roto-Jet™ with R90C nozzles in 4 inch inner diameter casing with a stand-off of approximately 1.22 inch, and a flow rate of 110 liters/minute through the tool in a fluid filled hole generated a 1021 psi pressure drop across the nozzles and 254 psi impact pressure.

EXAMPLE 4

A 2.125 inch Roto-Jet™ with R90C nozzles was used to clean a typical gravel pack with 40/60 sand with a 4 inch base pipe screen and 0.008 inch gap wire wound screen. The casings size is 6.5 inch inner diameter. ROP would be ½ meters/minute. Pump rate 105 liters/minute. Impact pressure is 224 psi. This is a solvent application rate of 210 liter/meter. One pass of solvent was made and then the solvent was flushed out at the same conditions except POOH at ¼ meter/minute.

While the compositions and methods of this invention have been described in terms of preferred embodiments, it will be apparent to those of skill in the art that variations may be applied to the process described herein without departing from the concept, spirit and scope of the invention. For instance, in instances where the gravel pack is plugged with essentially soluble plugging materials, the pack may be washed by simply delivering a pressure pulsating treatment fluid into the gravel pack and dissolving the soluble plugging materials with the treatment fluid. Conversely, in instances where the gravel pack is plugged with essentially insoluble plugging materials, the pack may be washed by delivering a pressure pulsating fluid into the gravel pack and moving the insoluble plugging materials through the gravel pack with the fluid. The insoluble materials could subsequently be circulated out of the wellbore. In this application, the fluid does not have to be a treatment fluid since the insoluble materials are being removed by the hydraulic oscillating of the plugging materials by the pulsating fluid. It will also be appreciated that the invention may be used to remove soluble and insoluble fines from open hole completions and cased hole completions in wells without screens or gravel packs. All such similar substitutes and modifications apparent to those skilled in the art are deemed to be within the spirit, scope and concept of the invention as it is set out in the following claims.

What is claimed is:

1. A method of uniformly placing a treatment fluid behind a screen into a gravel pack comprising the steps of generating a localized yet fluctuating pressure gradient in the pack which encourages radial flow through the pack, achieving the fluctuating pressure gradient by the controlled rotation of a jetting nozzle operating at a flow rate sufficient to generate an impact pressure at the screen proppant interface which is below a pre-determined critical damage threshold pressure.

2. The method of claim 1 further comprising establishing a tangential vortex with the treatment fluid, thereby directing treatment fluid behind the screen and into the gravel pack.

3. The method of claim 2 further comprising orienting the jetting nozzle to have an axial downward component to the jet direction.

4. The method of claim 2 further comprising creating an annular region of shiny with low proppant concentration behind the screen.

5. The method of claim 4 further comprising maintaining the flow rate of the treatment fluid in the upward direction in the annular region of low proppant concentration above about four inches/second.

6. The method of claim 1 further comprising reducing the angle of repose of the proppant in the pack and increasing the packing density of the pack.

7. The method of claim 1 further comprising dissolving soluble plugging materials in the gravel pack with the treatment fluid.

8. The method of claim 1 further comprising moving insoluble plugging materials through the gravel pack and circulating the insoluble plugging materials out of the wellbore.

9. The method of claim 1 further comprising removing scale with the treatment fluid from the inner diameter of the screen.

10. The method of claim 1 further comprising breaking the bonds between the proppant particles and any cementatious precipitate in the gravel pack.

11. The method of claim 1 wherein the pre-determined critical damage threshold pressure removes about 3% or less of the proppant from the pack.

12. The method of claim 1 wherein the pre-determined critical damage threshold pressure removes about 1% or less of the proppant from the pack.

13. The method of claim 12 further comprising displacing the treatment fluid with a displacement fluid by means of a tangential vortex.

14. A method of uniformly placing a treatment fluid behind a screen into a gravel pack in a wellbore comprising the steps of delivering a pressure pulsating jet of treatment fluid through a jet nozzle against the screen;

creating a tangential vortex beneath the jet nozzle with the treatment fluid wherein at least a portion of the treatment fluid is directed through the screen and into the gravel pack before returning to the surface.

15. The method of claim 14 or further comprising delivering the treatment fluid through the gravel pack and into perforation tunnels extending into a subterranean formation, reducing the angle of repose of the proppant in the pack and the perforation tunnels and increasing the packing density of the proppant in the pack and perforation tunnels.

16. The method of claim 14 further comprising orienting the jet nozzle to have an axial downward component to the jet direction.

17. The method of claim 14 further comprising creating an annular region of slurry with low proppant concentration behind the screen.

18. The method of claim 17 further comprising maintaining the flow rate of the treatment fluid in the upward direction in the annular region of low proppant concentration above the threshold transport velocity to suspend the proppants in said annular region.

19. The method of claim 14 further comprising dissolving soluble plugging materials in the gravel pack with the treatment fluid.

20. The method of claim 14 further comprising moving insoluble plugging materials through the gravel pack and circulating the insoluble plugging materials out of the wellbore.

21. The method of claim 19 or 20 further comprising removing scale with the treatment fluid from the inner diameter of the screen in a single trip wellbore.

22. The method of claim 14 further comprising breaking the bonds between the proppant particles and any cementatious precipitate in the gravel pack.

23. The method of claim 14 wherein the jet is passed through the gravel pack at a rate ranging from about 0.2 meters per minute to about 10 meters per minute.

24. A method of cleaning a gravel pack in a wellbore comprising the steps of:

delivering a pressure pulsating jet of treatment fluid onto a gravel pack screen with one or more jetting nozzles;

creating a tangential vortex of treatment fluid in the region below the one or more nozzles, thereby directing treatment fluid behind the screen and into the gravel pack;

dissolving soluble plugging materials in the gravel pack with the treatment fluid; and moving insoluble plugging materials through the gravel pack and circulating the insoluble plugging materials out of the wellbore.

25. The method of claim 24 further comprising orienting the one or more jetting nozzles to provide an axial downward component to the jet direction.

26. The method of claim 25 further comprising creating an annular rate of slurry with low proppant concentration behind the screen.

27. The method of claim 26 further comprising maintaining the flow rate of the treatment fluid in the upward direction in the annular region of low proppant concentration above about 4 inches/second.

28. The method of claim 25 further comprising reducing the angle of repose of the proppant in the pack and increasing the packing density of the pack.

29. The method of claim 24 further comprising restricting the treatment fluid from returning up the wellbore past the jetting nozzles by the cross sectional area of the jet beneath the one or more jetting nozzles.

30. The method of claim 24 further comprising delivering the pressure pulsating jet of treatment fluid onto the screen proppant interface at an impact pressure below a preselected critical damage threshold pressure.

31. The method of claim 30 wherein the predetermined critical damage threshold pressure removes about 3% or less of the proppant from the pack.

32. The method of claim 30 wherein the predetermined critical damage threshold pressure removes about 1% or less of the proppant from the pack.

33. The method of claim 30 wherein the pressure pulsating treatment fluid is delivered at an impact pressure of about 50 to about 500 psi.

34. The method of claim 30 wherein the pressure pulsating treatment fluid is delivered at an impact pressure of about 5 psi to about 850 psi.

35. The method of claim 24 further comprising displacing the treatment fluid with a pressure pulsating jet of displacement fluid.

36. The method of claim 24 further comprising lowering the one or more jetting nozzles through the gravel pack screen while delivering the pressure pulsating jet of treatment fluid into the gravel pack.

37. The method of claim 24 further comprises delivering the treatment fluid through the gravel pack and into perforation tunnels extending into a subterranean formation.

38. The method of claim 37 further comprising reducing the angle of repose of the proppant in the pack and the perforation tunnels and increasing the packing density of the proppant in the pack and perforation tunnels.

39. The method of claim 38 further comprising cleaning the gravel pack with about 40 liters to about 400 liters of acid per meter of gravel pack.

40. The method of claim 24 wherein the treatment fluid is an acid selected from hydrochloric or hydrofluoric acids.

41. The method of claim 24 further comprising moving non-dissolved soluble plugging materials through the gravel pack and circulating the non-dissolved soluble materials out of the wellbore.

42. The method of claim 24 wherein the one or more jetting nozzles are lowered through the gravel pack at a rate ranging from about 0.2 meters per minute to about 10 meters per minute.

43. The method of claim 42 further comprising lowering a jet which creates the tangential vortex through the gravel pack screen while delivering the treatment fluid into the gravel pack.

44. The method of claim 42 further comprises delivering the treatment fluid through the gravel pack and into perforation tunnels extending into a subterranean formation.

45. The method of claim 44 further comprising treating the gravel pack with about 40 liters to about 400 liters of acid per meter of gravel pack.

46. The method of claim 44 further comprising reducing the angle of repose of the proppant in the pack and the perforation tunnels and increasing the packing density of the proppant in the pack and perforation tunnels.

47. The method of claim 42 wherein the treatment fluid is an acid.

48. The method of claim 47 wherein the acid is selected from hydrochloric or hydrofluoric acids.

* * * * *

UNITED STATES PATENT AND TRADEMARK OFFICE

CERTIFICATE OF CORRECTION

PATENT NO. : 6,832,655 B2 
DATED : December 21, 2004
INVENTOR(S) : John Ravensbergen, John Gordon Misselbrook and Lance Nigel Portman It is certified that error appears in the above-identified patent and that said Letters Patent is hereby corrected as shown below:

Column 14,
Line 2, delete "shiny" and insert -- slurry --.

Column 15,
Line 1, after "or" insert -- 1--.

Signed and Sealed this

Nineteenth Day of April, 2005

JON W. DUDAS
*Director of the United States Patent and Trademark Office*